US011111638B2

(12) United States Patent
Marsolek

(10) Patent No.: US 11,111,638 B2
(45) Date of Patent: Sep. 7, 2021

(54) COMPACTION DRUM AND METHOD OF COMPACTION

(71) Applicant: Caterpillar Paving Products Inc., Brooklyn Park, MN (US)

(72) Inventor: John Lee Marsolek, Watertown, MN (US)

(73) Assignee: Caterpillar Paving Products Inc, Brooklyn Park, MN (US)

( * ) Notice: Subject to any disclaimer, the term of this patent is extended or adjusted under 35 U.S.C. 154(b) by 64 days.

(21) Appl. No.: 16/589,717

(22) Filed: Oct. 1, 2019

(65) Prior Publication Data

US 2021/0095431 A1 Apr. 1, 2021

(51) Int. Cl.

*E01C 19/00* (2006.01)
*E01C 19/23* (2006.01)
*E01C 19/26* (2006.01)

(52) U.S. Cl.

CPC ..... *E01C 19/236* (2013.01); *E01C 19/26* (2013.01)

(58) Field of Classification Search

CPC ..... E01C 19/236; E01C 19/26
USPC ..... 404/121, 124
See application file for complete search history.

(56) References Cited

U.S. PATENT DOCUMENTS 1,501,937 A * 7/1924 Benjamin ..... B60B 15/025 301/41.1
2,754,734 A * 7/1956 Gardner ..... E02D 3/026 404/124
3,220,369 A * 11/1965 Gandrud ..... A01B 29/04 111/130
3,276,337 A * 10/1966 Gardner ..... E01C 19/236 404/124
3,823,983 A * 7/1974 Peterson ..... E02D 3/026 301/43
RE33,312 E * 8/1990 Elliot ..... E01C 19/236 172/554
5,033,906 A * 7/1991 Jordan ..... B44B 5/0009 404/124
5,228,799 A * 7/1993 Sondreal ..... E01C 19/43 404/124
5,421,670 A * 6/1995 Meirick ..... E01C 19/43 404/124
5,687,799 A * 11/1997 Greenfield ..... E02D 3/026 172/540
6,968,907 B1 * 11/2005 Raper ..... A01B 29/045 172/518

(Continued)

FOREIGN PATENT DOCUMENTS

CN 1341343 3/2002

*Primary Examiner* — Raymond W Addie
(74) *Attorney, Agent, or Firm* — Xsensus LLC

(57) ABSTRACT

A compaction drum can include an outer surface defining a width. The compaction drum also can include a plurality of pads disposed on the outer surface of the compaction drum and positioned in at least one row. Each of the plurality of pads can be disposed circumferentially spaced apart relative to one another on the outer surface. Each of the plurality of pads can define a first height. The compaction drum further can include a plurality of ribs disposed on the outer surface. Each of the plurality of ribs can be connected between adjacent pads of the plurality of pads. Each of the plurality of ribs can define a second height. The second height of each of the plurality of ribs can be approximately equal to the first height of each of the plurality of pads.

20 Claims, 5 Drawing Sheets

(56) References Cited

U.S. PATENT DOCUMENTS

| | | | | |
|---|---|---|---|---|
| 8,007,200 | B2 * | 8/2011 | Brockway | E02D 3/039 404/124 |
| 8,807,669 | B2 * | 8/2014 | McPhail | B60S 1/68 305/107 |
| 9,181,671 | B2 | 11/2015 | Thomson et al. | |
| 9,206,576 | B2 | 12/2015 | Meier | |
| 9,399,848 | B2 | 7/2016 | Haubrich et al. | |
| 10,030,341 | B1 | 7/2018 | Burger | |
| 2006/0070533 | A1 | 4/2006 | Silcock et al. | |
| 2007/0280783 | A1 * | 12/2007 | Gibbins | E02D 3/026 404/124 |
| 2008/0075534 | A1 * | 3/2008 | L. Stern | E02D 3/026 404/121 |
| 2009/0045669 | A1 | 2/2009 | McPhail et al. | |
| 2016/0047103 | A1 * | 2/2016 | Pratt | E01C 19/266 404/121 |
| 2016/0108595 | A1 | 4/2016 | Brockway | |
| 2017/0167087 | A1 | 6/2017 | Frelich | |
| 2018/0187381 | A1 * | 7/2018 | Meier | E01C 19/266 |

* cited by examiner

COMPACTION DRUM AND METHOD OF COMPACTION

TECHNICAL FIELD

The present disclosure relates to a compaction drum for a compaction machine. More particularly, the present disclosure relates to a method for compacting a soil surface using the compaction machine.

BACKGROUND

Typically, a compaction machine, such as a vibratory roller, may employ a compaction drum in order to perform compaction of a soil surface. In many situations, the compaction drum may include a number of pads or cleats in order to provide a desired level of compaction of the soil surface. During a compaction process, as the compaction drum may roll over the soil surface to be compacted, the pads may form a number of recesses on the soil surface. As such, during rainy weather, water may collect in the recesses.

In many situations, the compacted soil surface may be relatively dense. Accordingly, the water collected in the recesses may require substantial amount of time to drain or dry out. As a result, the compaction process may have to be discontinued until withdrawal of rain and/or drainage of recesses, in turn, increasing process time, reducing productivity, and increasing costs. Hence, there is a need for an improved compaction drum and an improved method for compacting the soil surface for such applications.

U.S. Patent Application Number 2006/0070533 describes a compactor wheel including a hub mountable to an axle of a compaction machine and a rim mounted around an outer circumference of the hub. The rim includes a wrapper having an inner circumferential edge and an outer circumferential edge. The compactor wheel also includes a plurality of cleat pads formed on the wrapper. Each of the plurality of cleat pads extend axially outward from the wrapper. The plurality of cleat pads is spaced apart from one another on the wrapper such that a valley is formed between each adjacent pair of cleat pads. A plurality of cleats is affixed to each of the plurality of cleat pads and extends radially outward therefrom.

SUMMARY OF THE DISCLOSURE

In an aspect of the present disclosure, a compaction drum is provided. The compaction drum includes an outer surface defining a width. The compaction drum also includes a plurality of pads disposed on the outer surface of the compaction drum and positioned in at least one row. Each of the plurality of pads is disposed circumferentially spaced apart relative to one another on the outer surface. Each of the plurality of pads defines a first height. The compaction drum further includes a plurality of ribs disposed on the outer surface. Each of the plurality of ribs is connected between adjacent pads of the plurality of pads. Each of the plurality of ribs defines a second height. The second height of each of the plurality of ribs is approximately equal to the first height of each of the plurality of pads.

In another aspect of the present disclosure, a compaction machine is provided. The compaction machine includes a frame and a power source mounted on the frame. The compaction machine also includes at least one compaction drum rotatably mounted to the frame and operably coupled to the power source. The compaction drum includes an outer surface defining a width. The compaction drum also includes a plurality of pads disposed on the outer surface of the compaction drum and positioned in at least one row. Each of the plurality of pads is disposed circumferentially spaced apart relative to one another on the outer surface. Each of the plurality of pads defines a first height. The compaction drum further includes a plurality of ribs disposed on the outer surface. Each of the plurality of ribs is connected between adjacent pads of the plurality of pads. Each of the plurality of ribs defines a second height. The second height of each of the plurality of ribs is approximately equal to the first height of each of the plurality of pads.

In yet another aspect of the present disclosure, a method for compacting a soil surface using a compaction machine is provided. The method includes providing at least one compaction drum on the compaction machine. The method includes providing a plurality of pads positioned in at least one row on the compaction drum. Each of the plurality of pads is disposed circumferentially spaced apart relative to one another. Each of the plurality of pads defines a first height. The method includes providing a plurality of ribs on the compaction drum. Each of the plurality of ribs is connected between adjacent pads of the plurality of pads. Each of the plurality of ribs defines a second height approximately equal to the first height of each of the plurality of pads. The method also includes forming a plurality of recesses positioned in at least one row on the soil surface by the plurality of pads. Each of the plurality of recesses defines a third height approximately equal to the first height of each of the plurality of pads. The method further includes forming a plurality of channels on the soil surface by the plurality of ribs. Each of the plurality of channels is connected between adjacent recesses of the plurality of recesses. Each of the plurality of channels defines a fourth height approximately equal to the third height of each of the plurality of recesses.

Other features and aspects of this disclosure will be apparent from the following description and the accompanying drawings.

DETAILED DESCRIPTION

Figure 1:
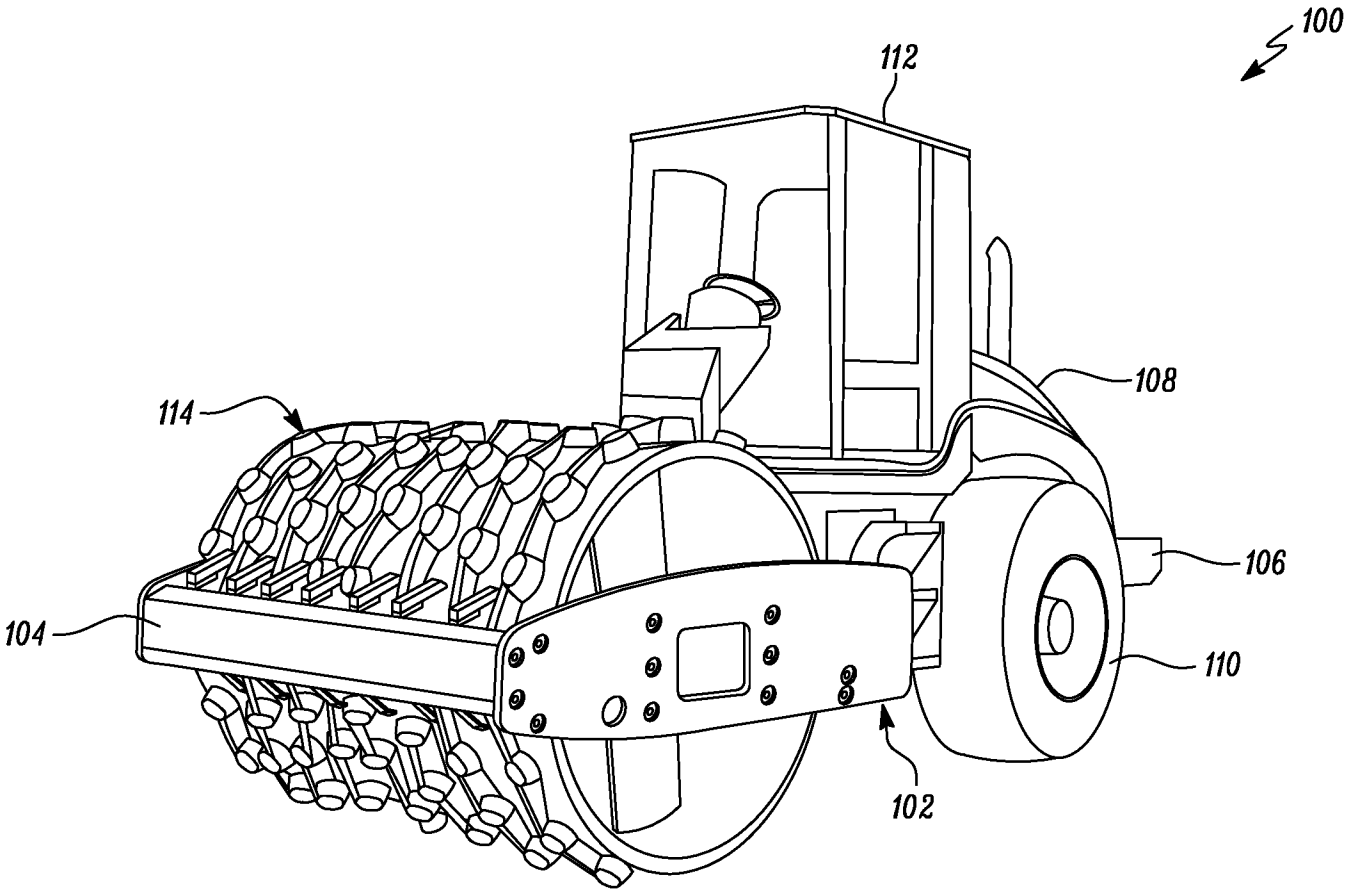
FIG. 1 is a perspective view of an exemplary compaction machine, according to one embodiment of the present disclosure.

Wherever possible, the same reference numbers will be used throughout the drawings to refer to the same or like parts. Referring to FIG. 1, an exemplary compaction machine 100 is illustrated. The compaction machine 100 will be hereinafter interchangeably referred to as the "machine 100". In the illustrated embodiment, the machine 100 is a vibratory type compaction machine. In other embodiments, the machine 100 may be a non-vibratory type compaction machine. Also, in the illustrated embodiment, the machine 100 is single drum type compaction machine. In other embodiments, the machine 100 may be a dual or multiple drum type compaction machine. The machine 100 may be associated with an industry, such as construction, mining, transportation, agriculture, waste management, and so on.

The machine 100 includes a frame 102. In the illustrated embodiment, the frame 102 includes a front portion 104 and a rear portion 106. The rear portion 106 is movably coupled to the front portion 104 via an articulation joint (not shown). In other embodiments, the frame 102 may have a singular, non-articulating configuration, such that the articulating joint may be omitted. The frame 102 supports one or more components of the machine 100. The machine 100 includes an enclosure 108 provided on the rear portion 106 of the frame 102. The enclosure 108 encloses a power source (not shown) mounted on the frame 102. The power source may be any power source, such as an internal combustion engine, batteries, motor, and so on, or a combination thereof. The power source may provide power to the machine 100 for mobility and operational requirements.

The machine 100 includes one or more ground engaging members 110. The ground engaging members 110 are rotatably mounted to the rear portion 106 of frame 102. In the illustrated embodiment, the ground engaging members 110 are wheels. In other embodiments, the ground engaging member 110 may be a compaction drum, pneumatic rollers, tracks, and so on, based on application requirements. The ground engaging members 110 support and provide mobility to the machine 100 on ground. The ground engaging members 110 also perform compaction of a surface, such as an asphalt surface, a soil surface, based on application requirements.

The machine 100 also includes an operator cabin 112 mounted on the frame 102. The operator cabin 112 houses one or more controls (not shown) of the machine 100, such as a display unit, a touchscreen unit, a steering, an operator console, switches, levers, pedals, knobs, buttons, and so on. The controls are adapted to control the machine 100 on ground. Additionally, the machine 100 may include components and/or systems (not shown), such as a fuel delivery system, an air delivery system, a lubrication system, a propulsion system, a drivetrain, a drive control system, a machine control system, and so on, based on application requirements.

Figure 2A:
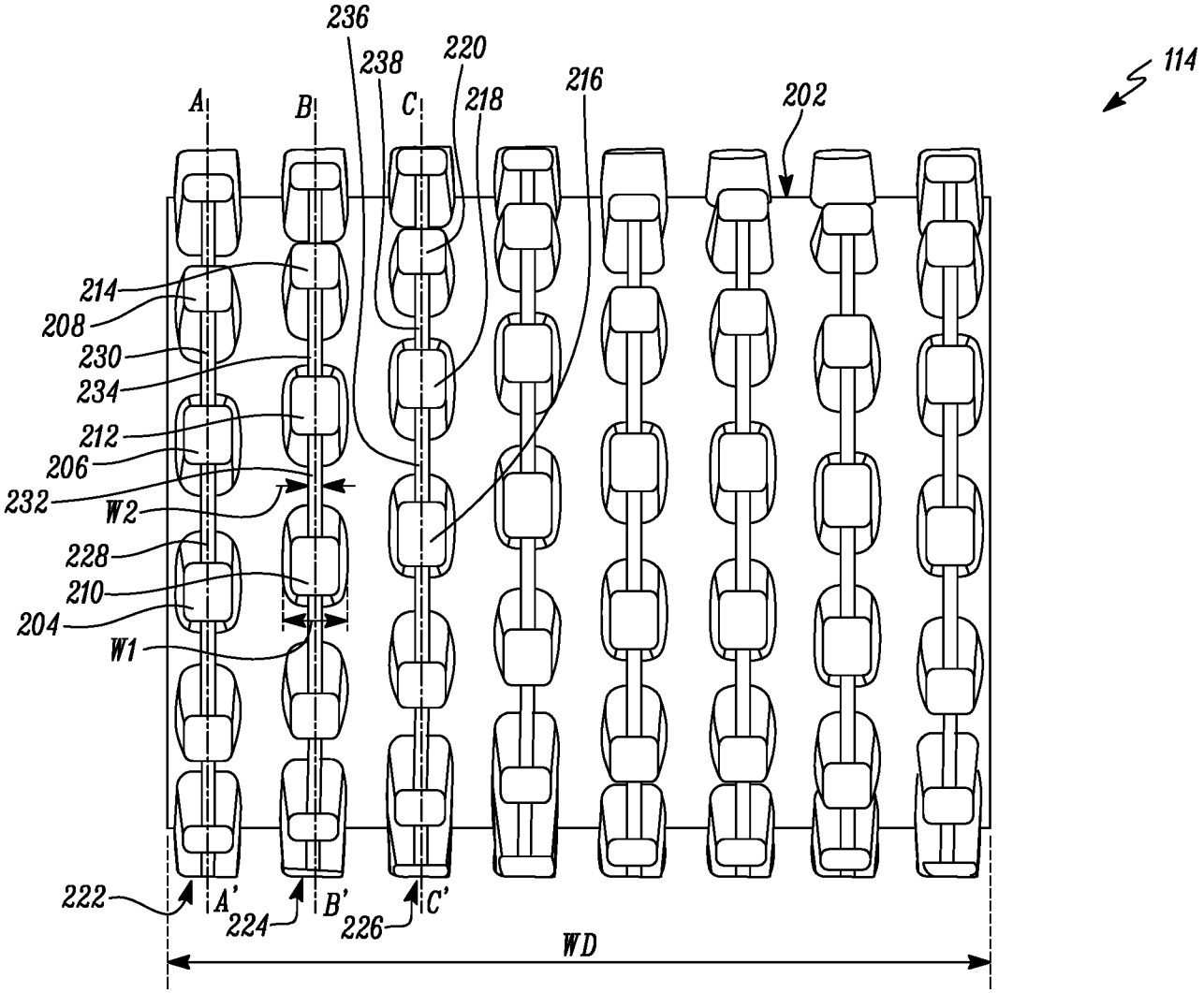
FIG. 2A is a front view of a compaction drum of the compaction machine, according to one embodiment of the present disclosure.
Figure 2B:
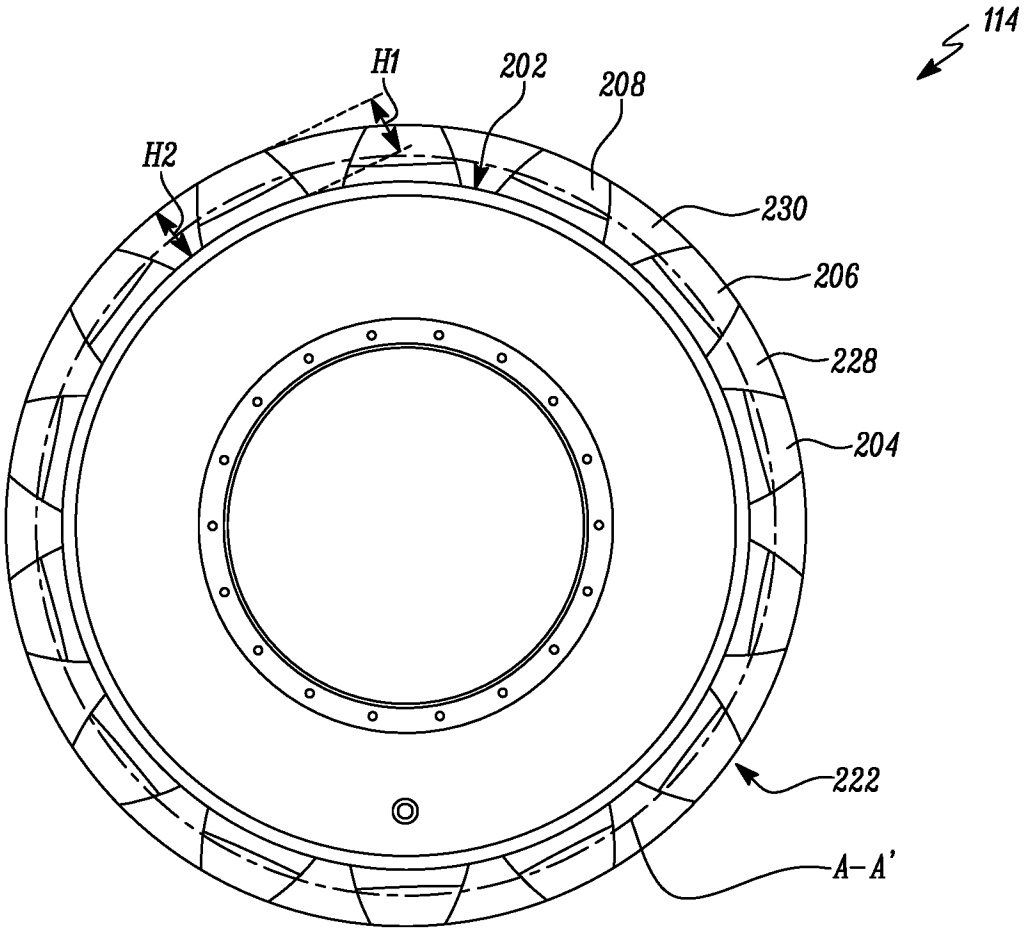
FIG. 2B is a side view of the compaction drum of the compaction machine, according to one embodiment of the present disclosure.

The machine 100 further includes at least one compaction drum 114. The compaction drum 114 will be hereinafter interchangeably referred to as the "drum 114". The drum 114 is rotatably mounted to the front portion 104 of the frame 102. Also, the drum 114 is operably coupled to the power source. The drum 114 performs compaction of the surface, such as the asphalt surface, the soil surface, and so on, based on application requirements. The drum 114 also supports and provides mobility to the machine 100 on ground. Referring to FIGS. 2A and 2B, different views of the drum 114 are illustrated. The drum 114 has a substantially hollow and cylindrical configuration. As such, the drum 114 includes an outer surface 202 defining a drum width "WD". In the illustrated embodiment, the drum 114 is padded type compaction drum. Accordingly, the drum 114 includes a plurality of pads disposed on the outer surface 202.

The plurality of pads includes a number of first pads 204, 206, 208, a number of second pads 210, 212, 214, a number of third pads 216, 218, 220, and so on. The plurality of pads is disposed on the outer surface 202 in at least one row. More specifically, the at least one row includes a plurality of rows, such as a first pad row 222, a second pad row 224, a third pad row 226, and so on. Each of the plurality of rows is disposed adjacent and laterally spaced apart relative to one another on the outer surface 202. More specifically, each of the first pad row 222, the second pad row 224, the third pad row 226, and so on are disposed adjacent and laterally spaced apart relative to one another on the outer surface 202. In the illustrated embodiment, the drum 114 includes eight rows disposed adjacent to one another on the outer surface 202. In other embodiments, the drum 114 may include single or multiple rows on the outer surface 202, based on application requirements.

Further, the first pad row 222 includes the number of first pads 204, 206, 208, the second pad row 224 includes the number of second pads 210, 212, 214, the third pad row 226 includes the number of third pads 216, 218, 220, and so on. In the illustrated embodiment, each of the first pad row 222, the second pad row 224, the third pad row 226, and so on includes fourteen pads. In other embodiments, each of the first pad row 222, the second pad row 224, the third pad row 226, and so on may include any or varying number of pads, based on application requirements. Each of the plurality of pads is disposed circumferentially spaced apart relative to one another on the outer surface 202. More specifically, each of the first pads 204, 206, 208 is disposed circumferentially spaced apart relative to one another on the outer surface 202. Each of the second pads 210, 212, 214 is disposed circumferentially spaced apart relative to one another on the outer surface 202. Each of the third pads 216, 218, 220 is disposed circumferentially spaced apart relative to one another on the outer surface 202, and so on.

Each of the plurality of pads defines a first height "H1". More specifically, each of the first pads 204, 206, 208, the second pads 210, 212, 214, the third pads 216, 218, 220, and so on defines the first height "H1". In the illustrated embodiment, an actual value of the first height "H1" of each of the first pads 204, 206, 208, the second pads 210, 212, 214, the third pads 216, 218, 220, and so on is approximately equal to one another. In other embodiments, an actual value of the first height "H1" of one or more of the first pads 204, 206, 208, the second pads 210, 212, 214, the third pads 216, 218, 220, and so on may be different from one another.

Each of the plurality of pads also defines a first width "W1". More specifically, each of the first pads 204, 206, 208, the second pads 210, 212, 214, the third pads 216, 218, 220, and so on defines the first width "W1". In the illustrated embodiment, an actual value of the first width "W1" of each of the first pads 204, 206, 208, the second pads 210, 212, 214, the third pads 216, 218, 220, and so on is approximately equal to one another. In other embodiments, an actual value of the first width "W1" of one or more of the first pads 204, 206, 208, the second pads 210, 212, 214, the third pads 216, 218, 220, and so on may be different from one another.

The drum 114 further includes a plurality of ribs disposed on the outer surface 202. Each of the plurality of ribs is connected between adjacent pads of the plurality of pads. More specifically, the plurality of ribs includes a number of first ribs 228, 230, a number of second ribs 232, 234, a number of third ribs 236, 238, and so on. Each of the first ribs 228, 230 is connected between adjacent first pads 204, 206, 208, respectively. For example, the first rib 228 is disposed between and connected to each of the first pads 204, 206, the first rib 230 is disposed between and connected to each of the first pads 206, 208, and so on. Also, each of the second ribs 232, 234 is connected between adjacent second pads 210, 212, 214, respectively. Further, each of the third ribs 236, 238 is connected between adjacent third pads 216, 218, 220, respectively, and so on.

The plurality of ribs associated with the at least one row is substantially parallel to the plurality of ribs associated with an adjacent row of the plurality of rows. More specifically, each of the first ribs 228, 230 associated with the first pad row 222 is substantially parallel to each of the second ribs 232, 234 associated with the second pad row 224 disposed adjacent to the first pad row 222. Also, each of the second ribs 232, 234 associated with the second pad row 224 is substantially parallel to each of the third ribs 236, 238 associated with the third pad row 226 disposed adjacent to the second pad row 224, and so on.

Each of the plurality of ribs is axially aligned relative to one another on the outer surface 202. More specifically, each of the first ribs 228, 230 is axially aligned relative to one another along a first rib axis A-A. Each of the second ribs 232, 234 is axially aligned relative to one another along a second rib axis B-B. Each of the third ribs 236, 238 is axially aligned relative to one another along a third rib axis C-C', and so on. Also, each of the plurality of pads is axially aligned relative to one another on the outer surface 202. More specifically, each of the first pads 204, 206, 208 is axially aligned relative to one another along the first rib axis A-A. Each of the second pads 210, 212, 214 is axially aligned relative to one another along the second rib axis B-B. Each of the third pads 216, 218, 220 is axially aligned relative to one another along the third rib axis C-C', and so on.

Each of the plurality of ribs defines a second height "H2". More specifically, each of the first ribs 228, 230, the second ribs 232, 234, the third ribs 236, 238, and so on defines the second height "H2". In the illustrated embodiment, an actual value of the second height "H2" of each of the first ribs 228, 230, the second ribs 232, 234, the third ribs 236, 238, and so on is approximately equal to one another. In other embodiments, an actual value of the second height "H2" of one or more of the first ribs 228, 230, the second ribs 232, 234, the third ribs 236, 238, and so on may be different from one another.

The second height "H2" of each of the plurality of ribs is approximately equal to the first height "H1" of each of the plurality of pads. More specifically, the second height "H2" of each of the first ribs 228, 230 is approximately equal to the first height "H1" of each of the first pads 204, 206, 208. The second height "H2" of each of the second ribs 232, 234 is approximately equal to the first height "H1" of each of the second pads 210, 212, 214. The second height "H2" of each of the third ribs 236, 238 is approximately equal to the first height "H1" of each of the third pads 216, 218, 220, and so on.

Each of the plurality of ribs also defines a second width "W2". More specifically, each of the first ribs 228, 230, the second ribs 232, 234, the third ribs 236, 238, and so on defines the second width "W2". In the illustrated embodiment, an actual value of the second width "W2" of each of the first ribs 228, 230, the second ribs 232, 234, the third ribs 236, 238, and so on is approximately equal to one another. In other embodiments, an actual value of the second width "W2" of one or more of the first ribs 228, 230, the second ribs 232, 234, the third ribs 236, 238, and so on may be different from one another.

The first width "W1" of each of the plurality of pads is greater than the second width "W2" of each of the plurality of ribs. More specifically, the first width "W1" of each of the first pads 204, 206, 208 is greater than the second width "W2" of each of the first ribs 228, 230. The first width "W1" of each of the second pads 210, 212, 214 is greater than the second width "W2" of each of the second ribs 232, 234. The first width "W1" of each of the third pads 216, 218, 220 is greater than the second width "W2" of each of the third ribs 236, 238, and so on.

In one embodiment, each of the plurality of ribs may be fixedly coupled to the outer surface 202. As such, each of the first ribs 228, 230, the second ribs 232, 234, the third ribs 236, 238, and so on may be coupled to the outer surface 202, such as by welding, adhesion, and so on. In another embodiment, each of the plurality of ribs may be removably coupled to the outer surface 202. As such, each of the first ribs 228, 230, the second ribs 232, 234, the third ribs 236, 238, and so on may be coupled to the outer surface 202, such as by fasteners, other removable couplers, and so on. In another embodiment, each of the plurality of ribs may be integrally formed on the outer surface 202. As such, each of the first ribs 228, 230, the second ribs 232, 234, the third ribs 236, 238, and so on may be integrally formed on the outer surface 202, such as by casting or additive manufacturing during manufacturing of the drum 114, and so on.

In one embodiment, each of the plurality of pads may be fixedly coupled to the outer surface 202. As such, each of the first pads 204, 206, 208, the second pads 210, 212, 214, the third pads 216, 218, 220, and so on may be coupled to the outer surface 202, such as by welding, adhesion, and so on. In another embodiment, each of the plurality of pads may be removably coupled to the outer surface 202. As such, each of the first pads 204, 206, 208, the second pads 210, 212, 214, the third pads 216, 218, 220, and so on may be coupled to the outer surface 202, such as by fasteners, other removable couplers, and so on. In another embodiment, each of the plurality of pads may be integrally formed on the outer surface 202. As such, each of the first pads 204, 206, 208, the second pads 210, 212, 214, the third pads 216, 218, 220, and so on may be integrally formed on the outer surface 202, such as by casting or additive manufacturing during manufacturing of the drum 114, and so on.

Figure 3:
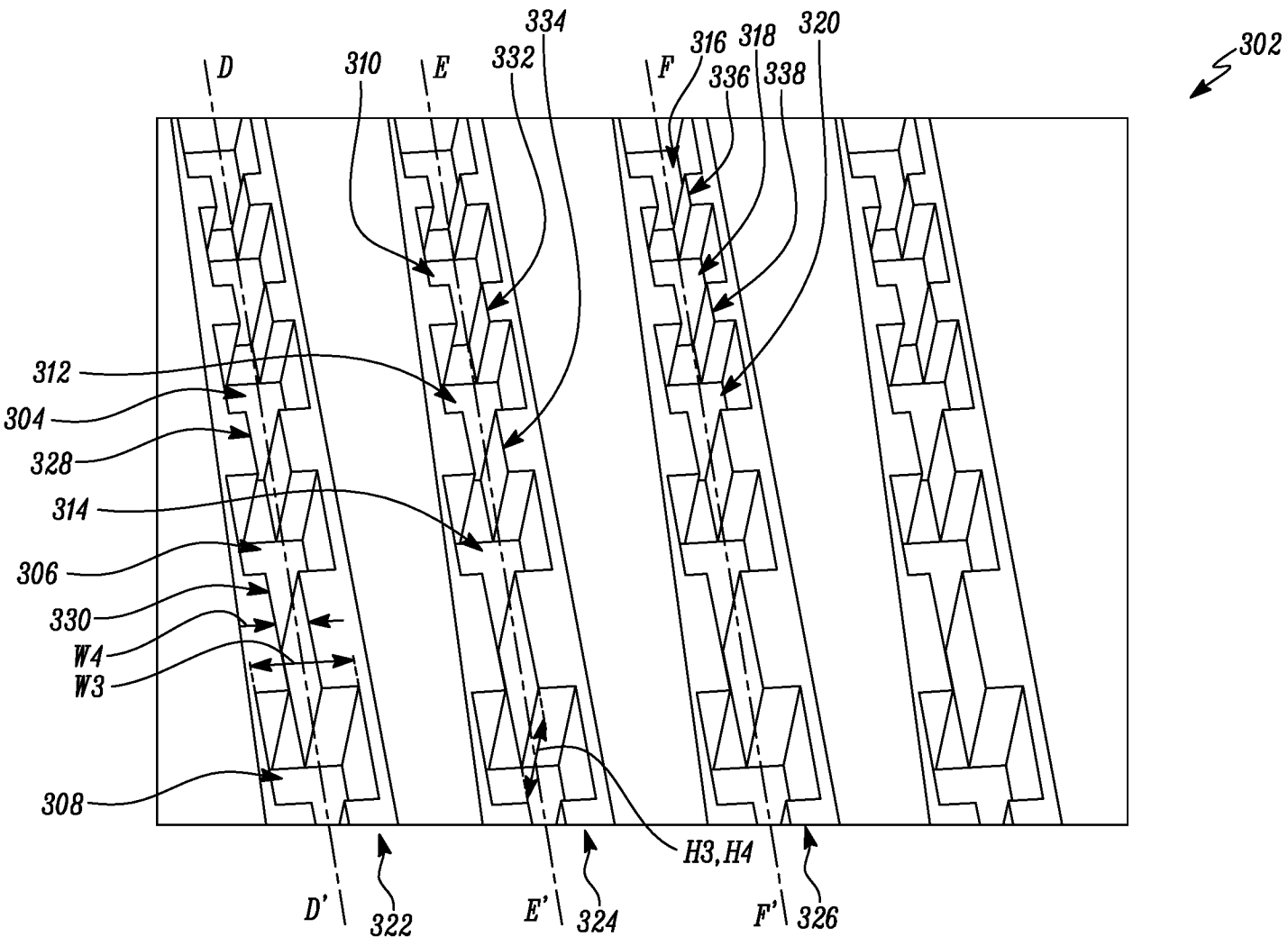
FIG. 3 is a perspective view showing a soil surface compacted using the compaction machine, according to one embodiment of the present disclosure.

Referring to FIG. 3, a perspective view of an exemplarily compacted soil surface 302 is illustrated. During compaction of the soil surface 302, the plurality of pads is adapted to form a plurality of recesses on the soil surface 302. The plurality of recesses includes a number of first recesses 304, 306, 308, a number of second recesses 310, 312, 314, a number of third recesses 316, 318, 320, and so on. The plurality of recesses is positioned in at least one row on the soil surface 302. More specifically, the at least one row includes a plurality of rows, such as a first recess row 322, a second recess row 324, a third recess row 326, and so on. As such, the first pads 204, 206, 208 are adapted to form the first recesses 304, 306, 308, respectively, positioned in the first recess row 322 on the soil surface 302. The second pads 210, 212, 214 are adapted to form the second recesses 310, 312, 314, respectively, positioned in the second recess row 324 on the soil surface 302. The third pads 216, 218, 220 are adapted to form the third recesses 316, 318, 320, respectively, positioned in the third recess row 326 on the soil surface 302, and so on.

Each of the plurality of recesses defines a third height "H3". More specifically, each of the first recesses 304, 306, 308, the second recesses 310, 312, 314, the third recesses 316, 318, 320, and so on defines the third height "H3". In the illustrated embodiment, an actual value of the third height "H3" of each of the first recesses 304, 306, 308, the second recesses 310, 312, 314, the third recesses 316, 318, 320, and so on is approximately equal to one another. In other embodiments, an actual value of the third height "H3" of one or more of the first recesses 304, 306, 308, the second recesses 310, 312, 314, the third recesses 316, 318, 320, and so on may be different from one another. Also, the third height "H3" of each of the plurality of recesses is approximately equal to the first height "H1" of each of the plurality of pads. More specifically, the third height "H3" of each of the first recesses 304, 306, 308, the second recesses 310, 312, 314, the third recesses 316, 318, 320, and so on is approximately equal to the first height "H1" of each of the first pads 204, 206, 208, the second pads 210, 212, 214, the third pads 216, 218, 220, and so on, respectively.

Each of the plurality of recesses also defines a third width "W3". More specifically, each of the first recesses 304, 306, 308, the second recesses 310, 312, 314, the third recesses 316, 318, 320, and so on defines the third width "W3". In the illustrated embodiment, an actual value of the third width "W3" of each of the first recesses 304, 306, 308, the second recesses 310, 312, 314, the third recesses 316, 318, 320, and so on is approximately equal to one another. In other embodiments, an actual value of the third width "W3" of one or more of the first recesses 304, 306, 308, the second recesses 310, 312, 314, the third recesses 316, 318, 320, and so on may be different from one another. Also, the third width "W3" of each of the plurality of recesses is approximately equal to the first width "W1" of each of the plurality of pads. More specifically, the third width "W3" of each of the first recesses 304, 306, 308, the second recesses 310, 312, 314, the third recesses 316, 318, 320, and so on is approximately equal to the first width "W1" of each of the first pads 204, 206, 208, the second pads 210, 212, 214, the third pads 216, 218, 220, and so on, respectively.

Also, during compaction of the soil surface 302, the plurality of ribs is adapted to form a plurality of channels on the soil surface 302. The plurality of channels includes a number of first channels 328, 330, a number of second channels 332, 334, a number of third channels 336, 338, and so on. More specifically, the first ribs 228, 230 are adapted to form the first channels 328, 330, respectively, on the soil surface 302. The second ribs 232, 234 are adapted to form the second channels 332, 334, respectively, on the soil surface 302. The third ribs 236, 238 are adapted to form the third channels 336, 338, respectively, on the soil surface 302, and so on.

Each of the plurality of channels is connected between adjacent recesses of the plurality of recesses. More specifically, each of the first channels 328, 330 is connected between adjacent first recesses 304, 306, 308, respectively. For example, the first channel 328 is connected between each of the first recesses 304, 306, the first channel 330 is connected between each of the first recesses 306, 308, and so on. Also, each of the second channels 332, 334 is connected between adjacent second recesses 310, 312, 314, respectively. Further, each of the third channels 336, 338 is connected between adjacent third recesses 316, 318, 320, respectively, and so on.

The plurality of channels associated with the at least one row is substantially parallel to the plurality of channels associated with an adjacent row of the plurality of rows. More specifically, each of the first channels 328, 330 associated with the first recess row 322 is substantially parallel to each of the second channels 332, 334 associated with the second recess row 324 disposed adjacent to the first recess row 322. Also, each of the second channels 332, 334 associated with the second recess row 324 is substantially parallel to each of the third channels 336, 338 associated with the third recess row 326 disposed adjacent to the second recess row 324, and so on.

Each of the plurality of channels is axially aligned relative to one another on the outer surface 202. More specifically, each of the first channels 328, 330 is axially aligned relative to one another along a first channel axis D-D. Each of the second channels 332, 334 is axially aligned relative to one another along a second channel axis E-E. Each of the third channels 336, 338 is axially aligned relative to one another along a third channel axis F-F', and so on. Also, each of the plurality of recesses is axially aligned relative to one another on the soil surface 302. More specifically, each of the first recesses 304, 306, 308 is axially aligned relative to one another along the first channel axis D-D. Each of the second recesses 310, 312, 314 is axially aligned relative to one another along the second channel axis E-E. Each of the third recesses 316, 318, 320 is axially aligned relative to one another along the third channel axis F-F', and so on.

Each of the plurality of channels defines a fourth height "H4". More specifically, each of the first channels 328, 330, the second channels 332, 334, the third channels 336, 338, and so on defines the fourth height "H4". In the illustrated embodiment, an actual value of the fourth height "H4" of each of the first channels 328, 330, the second channels 332, 334, the third channels 336, 338, and so on is approximately equal to one another. In other embodiments, an actual value of the fourth height "H4" of one or more of the first channels 328, 330, the second channels 332, 334, the third channels 336, 338, and so on may be different from one another.

The fourth height "H4" of each of the plurality of channels is approximately equal to the third height "H3" of each of the plurality of recesses. More specifically, the fourth height "H4" of each of the first channels 328, 330 is approximately equal to the third height "H3" of each of the first recesses 304, 306, 308. The fourth height "H4" of each of the second channels 332, 334 is approximately equal to the third height "H3" of each of the second recesses 310, 312, 314. The fourth height "H4" of each of the third channels 336, 338 is approximately equal to the third height "H3" of each of the third recesses 316, 318, 320, and so on.

Each of the plurality of channels also defines a fourth width "W4". More specifically, each of the first channels 328, 330, the second channels 332, 334, the third channels 336, 338, and so on defines the fourth width "W4". In the illustrated embodiment, an actual value of the fourth width "W4" of each of the first channels 328, 330, the second channels 332, 334, the third channels 336, 338, and so on is approximately equal to one another. In other embodiments, an actual value of the fourth width "W4" of one or more of the first channels 328, 330, the second channels 332, 334, the third channels 336, 338, and so on may be different from one another.

The fourth width "W4" of each of the plurality of channels is approximately equal to the second width "W2" of each of the plurality of ribs. More specifically, the fourth width "W4" of each of the first channels 328, 330 is approximately equal to the second width "W2" of each of the first ribs 228, 230. The fourth width "W4" of each of the second channels 332, 334 is approximately equal to the second width "W2" of each of the second ribs 232, 234. The fourth width "W4" of each of the third channels 336, 338 is approximately equal to the second width "W2" of each of the third ribs 236, 238, and so on.

The third width "W3" of each of the plurality of recesses is greater than the fourth width "W4" of each of the plurality of channels. More specifically, the third width "W3" of each of the first recesses 304, 306, 308 is greater than the fourth width "W4" of each of the first channels 328, 330. The third width "W3" of each of the second recesses 310, 312, 314 is greater than the fourth width "W4" of each of the second channels 332, 334. The third width "W3" of each of the third recesses 316, 318, 320 is greater than the fourth width "W4" of each of the third channels 336, 338, and so on.

Each of the plurality of channels is adapted to provide fluid communication between respective recesses of the plurality of recesses. As such, each of the first channels 328, 330 is adapted to provide fluid communication between adjacent first recesses 304, 306, 308, respectively. Each of the second channels 332, 334 is adapted to provide fluid communication between adjacent second recesses 310, 312, 314, respectively. Each of the third channels 336, 338 is adapted to provide fluid communication between adjacent third recesses 316, 318, 320, respectively, and so on, and will be explained in more detail later.

INDUSTRIAL APPLICABILITY

Figure 4:
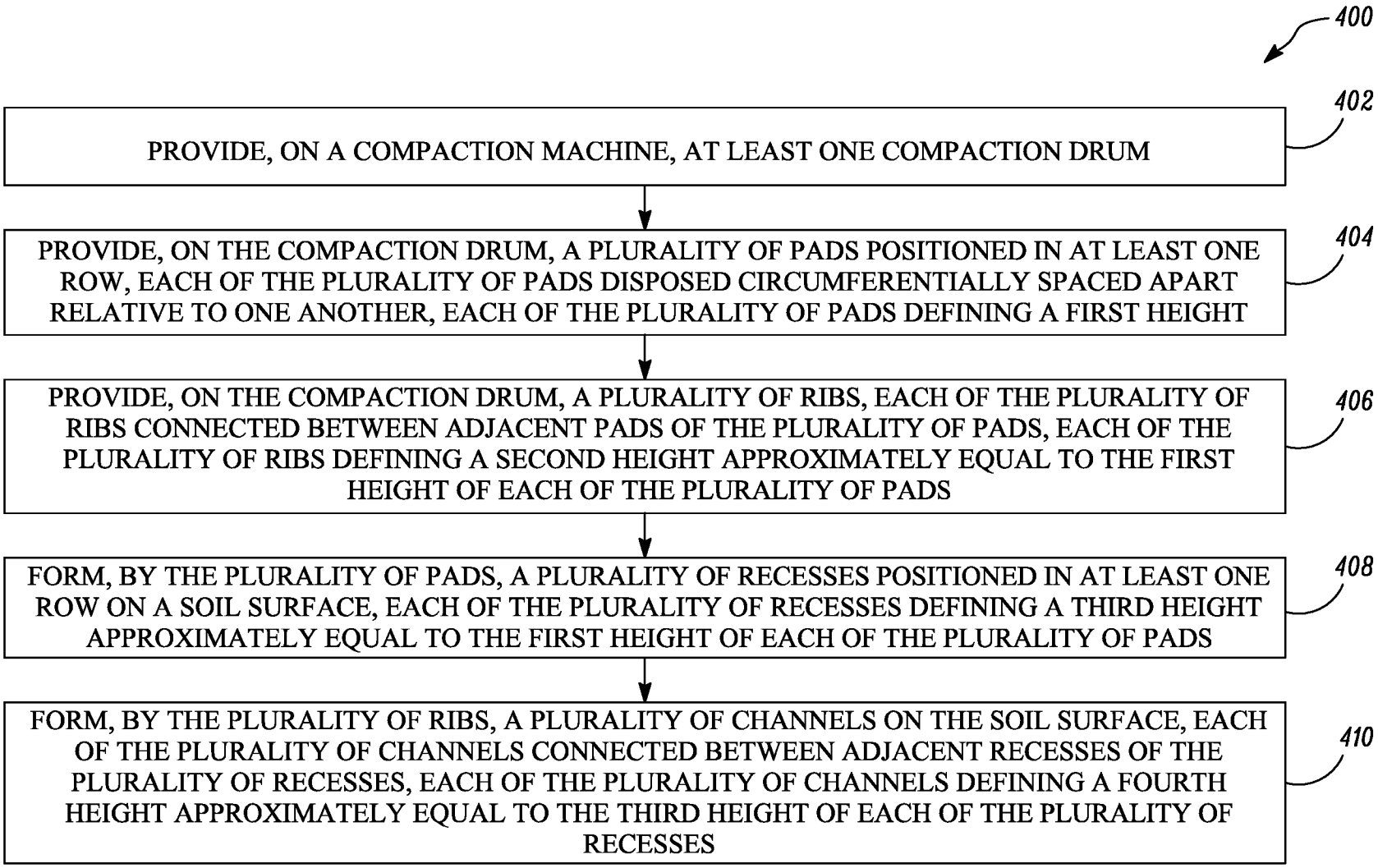
FIG. 4 is a flowchart illustrating a method of compacting the soil surface using the compaction machine, according to one embodiment of the present disclosure.

The present disclosure relates to a method 400 for compacting the soil surface 302 using the compaction machine 100. Referring to FIG. 4, a flowchart of the method 400 is illustrated. At step 402, the at least one compaction drum 114 is provided on the compaction machine 100. The drum 114 is the padded type compaction drum as described with reference to FIGS. 1, 2A, and 2B. Accordingly, at step 404, the plurality of pads is provided on the compaction drum 114 as described with reference to FIGS. 2A and 2B. The plurality of pads is positioned in the at least one row on the outer surface 202. More specifically, each of the first pads 204, 206, 208 is positioned in the first pad row 222, each of the second pads 210, 212, 214 is positioned in the second pad row 224, each of the third pads 216, 218, 220 is positioned in the third pad row 226, and so on. Also, each of the plurality of pads is disposed circumferentially spaced apart relative to one another on the outer surface 202. Further, each of the plurality of pads defines the first height "H1".

At step 406, the plurality of ribs is provided on the compaction drum 114 as described with reference to FIGS. 2A and 2B. Each of the plurality of ribs is connected between the adjacent pads of the plurality of pads. More specifically, each of the first ribs 228, 230 is connected between adjacent first pads 204, 206, 208, respectively. Each of the second ribs 232, 234 is connected between adjacent second pads 210, 212, 214, respectively. Each of the third ribs 236, 238 is connected between adjacent third pads 216, 218, 220, respectively, and so on. Also, each of the plurality of ribs defines the second height "H2". The second height "H2" is approximately equal to the first height "H1" of each of the plurality of pads.

At step 408, the plurality of recesses is formed by the plurality of pads on the soil surface 302 as described with reference to FIG. 3. Accordingly, the plurality of recesses is positioned in the at least one row on the soil surface 302. More specifically, each of the first recesses 304, 306, 308 is positioned in the first recess row 322, each of the second recesses 310, 312, 314 is positioned in the second recess row 324, each of the third recesses 316, 318, 320 is positioned in the third recess row 326, and so on. Also, each of the plurality of recesses defines the third height "H3". The third height "H3" is approximately equal to the first height "H1" of each of the plurality of pads.

At step 410, the plurality of channels is formed by the plurality of ribs on the soil surface 302 as described with reference to FIG. 3. Accordingly, each of the plurality of channels is connected between adjacent recesses of the plurality of recesses. More specifically, each of the first channels 328, 330 is connected between adjacent first recesses 304, 306, 308, respectively. Each of the second channels 332, 334 is connected between adjacent second recesses 310, 312, 314, respectively. Each of the third channels 336, 338 is connected between adjacent third recesses 316, 318, 320, respectively, and so on. Each of the plurality of channels defines the fourth height "H4". The fourth height "H4" is approximately equal to the third height "H3" of each of the plurality of recesses.

Also, the first width "W1" of each of the plurality of pads is approximately equal to the third width "W3" of each of the plurality of recesses. The second width "W2" of each of the plurality of ribs is approximately equal to the fourth width "W4" of each of the plurality of channels. Further, the third width "W3" of each of the plurality of recesses is greater than the fourth width "W4" of each of the plurality of channels. The plurality of channels provides a simple, effective, and cost-efficient method for providing fluid communication between the plurality of recesses on the soil surface 302.

As such, during rainy weather, when the plurality of recesses may be filled with water, the plurality of channels may provide drainage of the water from the plurality of recesses. For example, in a situation when the compacted soil surface 302 may include a gradient, the first recess 304 may be positioned at a relatively higher elevation with respect to the first recess 306, the first recess 306 may be positioned at a relatively higher elevation with respect to the first recess 308, and so on. In such a situation, the first channel 328 may provide drainage of the water filled in the first recess 304 into the first recess 306, the first channel 330 may provide drainage of the water filled in the first recess 306 into the first recess 308, and so on. As such, the water filled in any of the plurality of recesses may drain out through the respective channel due to the gradient and gravity. Accordingly, compaction of the soil surface 302 may also be performed during rainy weather which in most cases may have to be temporarily discontinued till withdrawal of rain or seepage/drainage of water from the plurality of recesses.

The plurality of ribs provided on the drum 114 provides a simple, effective, and cost-efficient method of providing the plurality of channels on the soil surface 302. The plurality of ribs may be manufactured using conventional materials, such as steel, and conventional manufacturing methods, such as casting, forging, fabrication, and so on, in turn, reducing complexity and costs. The plurality of ribs may be coupled to the drum 114 using conventional coupling methods, such as welding, fasteners, and so on, in turn, reducing complexity and costs. The plurality of ribs may be retrofitted on any compaction drum with little or no modification to the existing design, in turn, improving flexibility and compatibility.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of the disclosure. Such embodiments should be understood to fall within the scope of the present disclosure as determined based upon the claims and any equivalents thereof

What is claimed is:

1. A compaction drum comprising:

an outer surface defining a width;

a plurality of rows of a plurality of pads, the plurality of pads for each of the rows disposed on the outer surface of the compaction drum, the plurality of pads for each of the rows being disposed circumferentially spaced apart relative to one another on the outer surface, and each of the plurality of pads defining a first height; and a plurality of ribs disposed on the outer surface fir each of the rows of pads, each of the plurality of ribs connected between adjacent pads of the plurality of pads, and each of the plurality of ribs defining a second height, wherein the second height of each of the plurality of ribs is equal to the first height of each of the plurality of pads.

2. The compaction drum of claim 1, wherein a first width of each of the plurality of pads is greater than a second width of each of the plurality of ribs.

3. The compaction drum of claim 1, wherein each of the plurality of ribs is fixedly coupled to the outer surface.

4. The compaction drum of claim 1, wherein each of the plurality of ribs is removably coupled to the outer surface.

5. The compaction drum of claim 1, wherein each of the plurality of ribs is integrally formed on the outer surface.

6. The compaction drum of claim 1, wherein each of the plurality of ribs for each of the rows is axially aligned relative to one another on the outer surface.

7. The compaction drum of claim 1, wherein each of the plurality of rows is disposed laterally spaced apart relative to one another on the outer surface.

8. The compaction drum of claim 7 wherein the plurality of ribs associated with one of the rows of the plurality of rows is substantially parallel to a plurality of ribs associated with an adjacent row of the plurality of rows.

9. A compaction machine comprising:

a frame;

a power source mounted on the frame; and at least one compaction drum rotatably mounted to the frame and operably coupled to the power source, the at least one compaction drum including:

an outer surface defining a width;

a plurality of pads disposed on the outer surface of the compaction drum and positioned in at least one row, each of the plurality of pads disposed circumferentially spaced apart relative to one another on the outer surface, and each of the plurality of pads defining a first height; and a plurality of ribs disposed on the outer surface and positioned in said at least one row, each of the plurality of ribs connected between adjacent pads of the plurality of pads, and each of the plurality of ribs defining a second height, wherein the second height of each of the plurality of ribs is equal to the first height of each of the plurality of pads, and wherein each said at least one row has an alternating configuration of the pads and the ribs connected between the adjacent pads that extends in a same plane continuously circumferentially around the outer surface of the compaction drum.

10. The compaction machine of claim 9, wherein a first width of each of the plurality of pads is greater than a second width of each of the plurality of ribs.

11. The compaction machine of claim 9, wherein each of the plurality of ribs is fixedly coupled to the outer surface.

12. The compaction machine of claim 9, wherein each of the plurality of ribs is removably coupled to the outer surface.

13. The compaction machine of claim 9, wherein each of the plurality of ribs is integrally formed on the outer surface.

14. The compaction machine of claim 9, wherein each of the plurality of ribs is axially aligned relative to one another on the outer surface.

15. The compaction machine of claim 9, wherein the at least one row includes a plurality of rows, each of the plurality of rows disposed laterally spaced apart relative to one another on the outer surface.

16. The compaction machine of claim 15, wherein the plurality of ribs associated with the at least one row is substantially parallel to a plurality of ribs associated with an adjacent row of the plurality of rows.

17. A method for compacting a soil surface using a compaction machine, the method comprising:

providing, on the compaction machine, at least one compaction drum;

providing, on the compaction drum, a plurality of pads positioned in each of a plurality of rows, each of the plurality of pads disposed circumferentially spaced apart relative to one another, and each of the plurality of pads defining a first height;

providing, on the compaction drum, a plurality of ribs positioned in each of the plurality of rows each of the plurality of ribs connected between adjacent pads of the plurality of pads, and each of the plurality of ribs defining a second height equal to the first height of each of the plurality of pads;

forming, by the plurality of pads, a plurality of recesses positioned in each of the plurality of rows on the soil surface, each of the plurality of recesses defining a third height equal to the first height of each of the plurality of pads; and forming, by the plurality of ribs, a plurality of channels positioned in each of the plurality of rows on the soil surface, each of the plurality of channels connected between adjacent recesses of the plurality of recesses, and each of the plurality of channels defining a fourth height equal to the third height of each of the plurality of recesses.

18. The method of claim 17, wherein a first width of each of the plurality of pads is equal to a third width of each of the plurality of recesses.

19. The method of claim 18, wherein a second width of each of the plurality of ribs is equal to a fourth width of each of the plurality of channels.

20. The method of claim 19, wherein the third width of each of the plurality of recesses is greater than the fourth width of each of the plurality of channels.

* * * * *